US008464798B2

(12) United States Patent
Nadkrynechny

(10) Patent No.: US 8,464,798 B2
(45) Date of Patent: Jun. 18, 2013

(54) PLUNGER FOR PERFORMING ARTIFICIAL LIFT OF WELL FLUIDS

(75) Inventor: Rick Nadkrynechny, Grande Prairie (CA)

(73) Assignee: T-RAM Canada, Inc., Grande Prairie (CA)

( * ) Notice: Subject to any disclaimer, the term of this patent is extended or adjusted under 35 U.S.C. 154(b) by 331 days.

(21) Appl. No.: 12/909,672

(22) Filed: Oct. 21, 2010

(65) Prior Publication Data

US 2011/0253382 A1 Oct. 20, 2011

Related U.S. Application Data

(60) Provisional application No. 61/342,407, filed on Apr. 14, 2010.

(51) Int. Cl.
*E21B 43/00* (2006.01)

(52) U.S. Cl.
USPC ..... 166/369; 166/68; 166/105

(58) Field of Classification Search
USPC ..... 166/369, 68, 105
See application file for complete search history.

(56) References Cited

U.S. PATENT DOCUMENTS

| | | | | |
|---|---|---|---|---|
| 4,070,134 | A | 1/1978 | Gramling | |
| 4,502,843 | A | 3/1985 | Martin | |
| 4,629,004 | A | 12/1986 | Griffin | |
| 4,923,372 | A | 5/1990 | Ferguson et al. | |
| 4,984,969 | A | 1/1991 | Fineberg | |
| 6,045,335 | A | 4/2000 | Dinning | |
| 6,059,040 | A | 5/2000 | Levitan et al. | |
| 6,148,923 | A | 11/2000 | Casey | |
| 6,176,309 | B1 | 1/2001 | Bender | |
| 6,554,580 | B1 | 4/2003 | Mayfield | |
| 6,637,510 | B2 | 10/2003 | Lee | |
| 6,725,916 | B2 | 4/2004 | Gray et al. | |
| 7,121,335 | B2 | 10/2006 | Townsend | |
| 7,314,080 | B2 | 1/2008 | Giacomino | |
| 7,438,125 | B2 | 10/2008 | Victor | |
| 7,475,731 | B2 | 1/2009 | Victor | |
| 7,513,301 | B2 | 4/2009 | Victor | |
| 7,690,425 | B2 | 4/2010 | Giacomino | |
| 7,793,728 | B2 * | 9/2010 | Bender | 166/373 |
| 8,256,504 | B2 * | 9/2012 | Brown | 166/68 |

FOREIGN PATENT DOCUMENTS

EP 2085572 A2 8/2009

OTHER PUBLICATIONS

Charles A. Templeton Machine Inc. "Oil Tools Catalog", revised Sep. 2004, pp. 1, 14, 25, obtained from <<www.charlesatempleton.com>>.

* cited by examiner

*Primary Examiner* — William P Neuder
(74) *Attorney, Agent, or Firm* — Oyen Wiggs Green & Mutala LLP

(57) ABSTRACT

A plunger for removing fluid from a gas producing well has a fluid path through the plunger body, a narrow passageway within the fluid path, and a central orifice at an end of the passageway. The plunger may have a lip within the fluid path spaced above the central orifice. The lip interacts with gas and fluid exiting the central orifice when the plunger is rising within the gas producing well. The plunger may have a bypass valve to allow the plunger to fall while the well is flowing, and may have a central constriction to regulate the rate of falling.

27 Claims, 11 Drawing Sheets

PLUNGER FOR PERFORMING ARTIFICIAL LIFT OF WELL FLUIDS

REFERENCE TO RELATED APPLICATION

This application claims the benefit under 37 U.S.C. §119 of U.S. Application No. 61/342,407 filed 14 Apr. 2010 and entitled PLUNGER FOR RAPID RECYCLING TO PERFORM ARTIFICIAL LIFT IN NATURAL GAS WELLS, the entirety of which is hereby incorporated by reference.

TECHNICAL FIELD

This application relates to methods and devices for improving fluid production from wells, and in particular to a plunger for performing artificial lift of well fluids and methods of use of the plunger.

BACKGROUND

In an oil or gas well, the bottom hole pressure and the gas to liquid ratio will eventually not support a natural flow therefrom. The well operator at that time must select an artificial lift to remove fluid from the well so as to resume production. A plunger lift is a form of artificial lift which may be utilized in maintaining production levels and stabilizing the rate of decline of production of oil and gas from a well.

Plunger lift is an established method for enhancing the removal of liquids from a well that is producing at least some natural gas. The liquids may be oil, hydrocarbon condensates, water, or any combination thereof. If permitted to accumulate in a well bore, these liquids build up to create a hydrostatic back pressure against the formation, which in turn reduces production and may ultimately stop production completely.

As the oil or gas flow rate and pressure decline in a well, the lifting efficiency declines. The well then may begin to "load up" and "log off". This means that gas being produced into the well bore can no longer carry the fluid produced to the surface. One reason for this is that, as liquid comes in contact with the wall of the production string or tubing, friction will occur. The velocity of that liquid is thus reduced and some of the liquid adheres to the tubing wall, creating a film of liquid on that tubing wall. Thus, that liquid does not reach the well head at the surface.

Additionally, as the flow continues to slow, the gas phase can no longer support liquid in either slug form or droplet form. This liquid along with the liquid film on the sides of the tubing begins to fall back to the bottom of the well. In a very aggravated situation there will be liquid in the bottom of the well with only a small amount of gas being produced at the surface. The produced gas must bubble through the liquid at the bottom of the well and then flow to the surface. Because of the low velocity, very little liquid if any is carried to the surface of the well by the gas.

The corresponding head of liquid in the bottom of the well exerts a back pressure against the producing formation, with a value corresponding to the vertical elevation of the liquid in the well, effectively terminating the well's ability to produce. A properly applied plunger lift system is able to bring such a well back to life and make it profitable.

A plunger lift system permits the well to be opened and closed so as to generate a sufficient pressure permitting the well to flow into the flow line. The plunger travels freely back and forth within the vertical tubing string, from the bottom of the well to the surface and back to the bottom. The plunger is used as a mechanical interface between the gas phase and the fluid phase in the well. When the well is closed at the surface, the plunger rests at the bottom of the well on top of a spring assembly. Pressure within the well rises as gas enters the well. When the well is opened at the surface, with all production being through the tubing, the well begins to flow and the pressure in the tubing decreases. Because the trapped gas in the casing/tubing annulus remains at a higher pressure than the tubing, the differential pressure between the two increases. The liquid level in the annulus decreases as the liquid is pushed downward where it "U tubes" into the tubing. The mechanical tolerance between the outside diameter of the plunger and the inside of the tubing leaves sufficient space for the liquid to bypass the plunger, allowing the plunger to remain initially resting on the bottom. Eventually gas within the tubing causes the plunger to move up the tubing string carrying the fluid load on top. A small amount of gas will bypass the plunger. This is useful as it scours the plunger and the tubing wall of fluid keeping all the fluid on top of the plunger. If the system has been properly engineered, virtually all the liquid can be removed from the well to permit the well to flow at the lowest production pressure possible. The use of such a plunger in the tubing minimizes any fluid fallback over the entire length of the tubing, irrespective of the depth of the well. Such a well may be operated at a lower bottom hole pressure since substantially all the liquid is removed from the well bore, thus enhancing its production.

In some cases, a plunger having a bypass valve that is open when the plunger is falling but closed when the plunger is rising in the well may be used. The bypass valve permits fluid to flow through the body of the plunger when open, and thus facilitates more rapid descent of the plunger within the well, avoiding the need to shut in the well when the plunger is falling. However, when closed, the bypass valve prevents fluid flow through the body of the plunger. With the bypass valve closed when the plunger is rising, the plunger can still be used to perform artificial lift.

A functional plunger lift apparatus requires sufficient gas to drive the system. A plunger lift apparatus will not work in oil wells that are producing no gas. As used herein, a "gas producing well" means an oil or gas well that is producing a sufficient quantity of gas for the implementation of a plunger lift system.

An industry misconception exists as to how much gas and pressure is required to successfully operate a plunger lift system. Because of this misconception, many wells have been placed on more expensive forms of artificial lift, such as pumping units or the like, than are really needed. As a result, optimum output has not been achieved, and capital expenditures have run much higher than necessary.

Generally accepted operating procedures suggest that a plunger lift should be operated at a lift speed in the range of approximately 750 feet per minute. If the well has too little pressure, for example so that the plunger is travelling at less than approximately 500 feet per minute, fluid could slip around the plunger, potentially preventing it from rising. Conversely, if the well has too much pressure, the plunger will ascend too quickly, for example at a rate of greater than 1000 feet per minute, potentially causing damage to surface equipment due to the significant amount of kinetic energy that must be dissipated when the plunger arrives at the surface.

There remains a need for more efficient plungers and plungers that can be operated at higher velocities and/or with less risk of damage to surface equipment.

The foregoing examples of the related art and limitations related thereto are intended to be illustrative and not exclusive. Other limitations of the related art will become apparent to those of skill in the art upon a reading of the specification and a study of the drawings.

SUMMARY

An aspect of the invention provides a plunger for performing artificial lift in a gas producing well. The plunger has a plunger body for sealingly engaging a tubing of the well, a fluid path through the plunger body, a passageway within the fluid path, and a central orifice at an end of the passageway. The plunger may have a radially inwardly directed lip within the fluid path and spaced above the central orifice. In some embodiments, the fluid path may have a lower chamber below the passageway and an upper chamber above the passageway. The upper chamber may be an internal fishing neck. In some embodiments, a majority of the material of the plunger by volume may be a material having a density of less than 4.54 g/cm$^3$.

In some embodiments, the plunger has a bypass valve. In some embodiments, the bypass valve has a cage coupled to the bottom end of the plunger body and a pin having a head and a shaft. The pin is slideably retained within the cage and moveable between an open position wherein the bypass valve allows gas and liquid to flow through the fluid path, and a closed position wherein the pin engages a bottom of the plunger body to limit the flow of gas and liquid through the fluid path. A fluid passageway extends through the head of the pin, and has a central orifice at an end of the passageway. The plunger with a bypass valve may have an internal constriction within the fluid path. A radially inwardly directed lip within the fluid path may be provided by the internal constriction.

In some embodiments, the plunger has a bypass valve in which the bottom end of the plunger has a seat for receiving a seal. The seat has one or more grooves configured to permit fluid to flow to the narrow passageway when the seal is sealingly engaged with the seat. In some such embodiments, the seal may be a ball and the seat may be curved to sealingly engage the ball.

In some embodiments, the plunger has a bypass valve and also has fluid channels through the body of the plunger for permitting fluid to flow through the narrow passageway when the bypass valve is in the closed position.

Another aspect of the invention provides a method of using a plunger to perform artificial lift in a gas-producing well. The method includes the steps of allowing a plunger having a fluid passageway therethrough to fall within a tubing of a well to the bottom of the well, allowing gas pressure to move the plunger upwardly within the tubing, and while the plunger is moving upwardly, allowing fluid to pass through a narrow passageway within the fluid passageway, the narrow passageway having a central orifice at one end. In some embodiments, the method may include the step of allowing the fluid exiting the central orifice to interact with a radially inwardly directed lip on the plunger.

Further aspects of the invention and features of example embodiments of the invention are described below.

BRIEF DESCRIPTION OF DRAWINGS

The appended drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
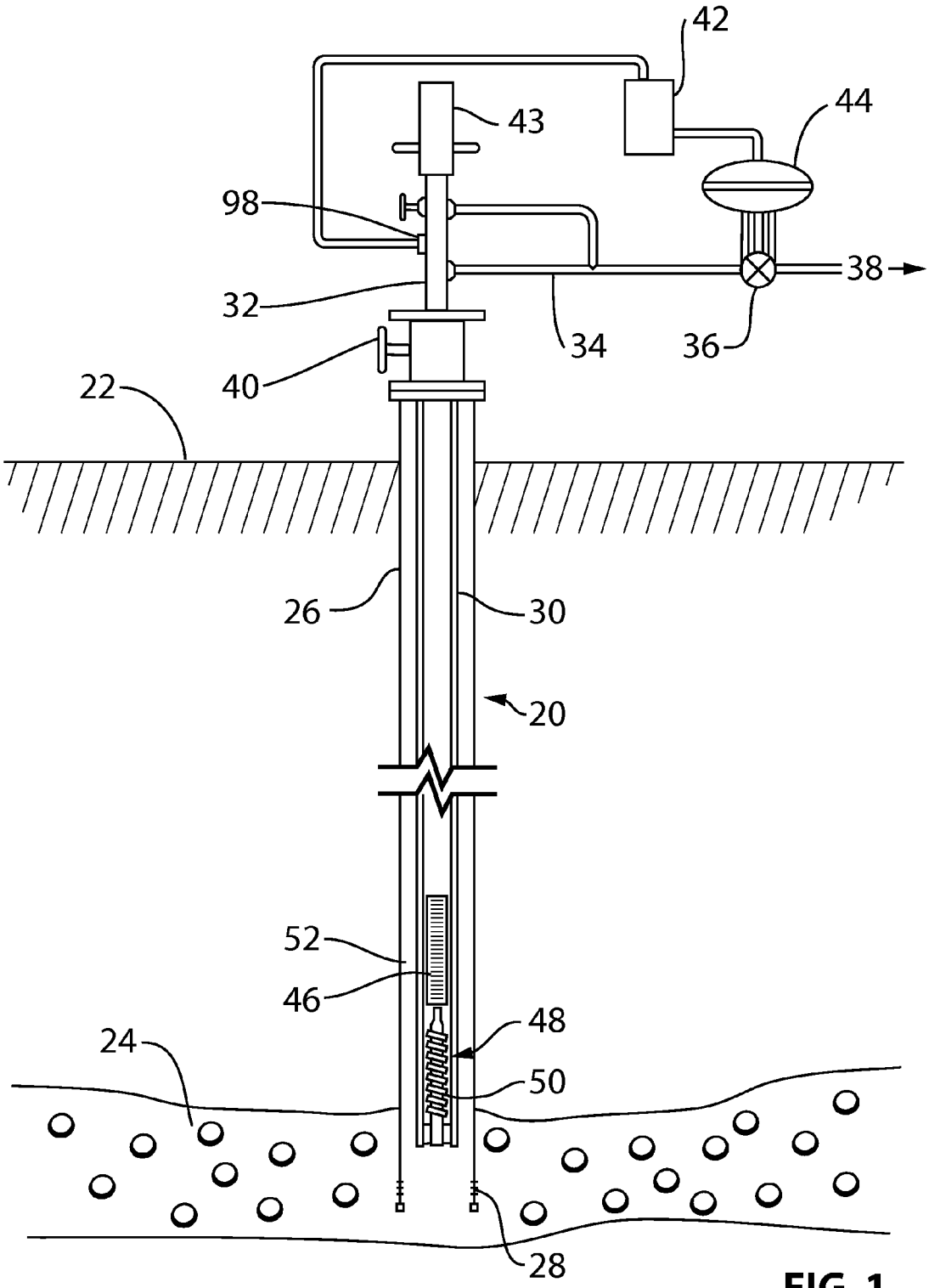
FIG. 1 is a schematic representation of a gas producing well showing a plunger disposed therein.

A typical well arrangement is shown in FIG. 1. A well 20 is drilled into the ground from the surface 22 to any producing underground formation 24. A production casing 26 is placed into the well bore, and perforations 28 are created in the casing at the level of formation 24 to allow gas and liquid to enter the well bore. A production tubing 30 is placed inside casing 26 and forms a continuous conduit for producing gas and liquid up through to a wellhead lubricator 32. Lubricator 32 is arranged to place a plunger 46 in well 20 and to retrieve plunger 46 from well 20 without having to kill well 20. The lubricator 32 may have a sensor, shown schematically as 98, to detect the arrival of plunger 46 at the surface 22, sending a signal to a control system 42 for various controller functions to help optimize production. Sensor 98 may comprise a magnetic sensor. The produced fluid exits through exit tubing 34 via a control valve 36 to move on to the next stage of collection, as indicated by arrow 38.

Well 20 includes a master valve 40, which can be used to stop the flow from well 20. Control valve 36 is regulated based on inputs from control system 42, which signals a valve actuator 44 configured to regulate control valve 36.

In operation, one embodiment of plunger 46 is inserted into well 20 as follows. Well 20 is prevented from flowing by closing master valve 40. A plunger 46 is inserted into lubricator 32 by removing a cap 43, inserting plunger 46 into lubricator 32, and replacing cap 43. Control valve 36 is kept in the closed position by valve actuator 44, which is controlled by input from control system 42. Master valve 40 is then opened, and typically control system 42 is then set to proceed with an operating mode and allowed to operate the well.

In the operating mode, when control valve 36 is in the closed position so that well 20 is shut in, plunger 46 free falls by gravity for a period of time, to allow plunger 46 to arrive at the bottom of well 20, contacting a bottom-hole stop 48, which may incorporate a spring 50. Bottom-hole stop 48 absorbs impact and prevents plunger 46 from passing through the bottom of production tubing 30.

After a period of time in the operating mode, control system 42 will signal valve actuator 44 to open control valve 36. This time period may be an established set time; a time calculated from other parameters such as plunger arrival time; a time calculated from pressure readings from casing 28, tubing 34, or a downstream collection system; or some combination of the foregoing; or, the time frame may be established in any other suitable manner. Control system 42 may also be manually operated to open control valve 36.

Upon control valve 36 opening, gas pressure which has accumulated in the annulus 52 between casing 26 and tubing 30 will flow through bottom-hole stop 48. Plunger 46 acts like a piston, providing a seal between the gas and liquid entering from below plunger 46 and the gas and liquid above plunger 46. Plunger 46 pushes liquid that has accumulated above plunger 46 to the surface 22, where it exits the pumping system, as shown by arrow 38, and is transported to a downstream separation and gathering apparatus.

Plunger 46 may remain in well 20 for a period of operation which may be from days or weeks up to several years depending on performance, well conditions, and the nature of plunger 46 or other well components used.

Figure 2:
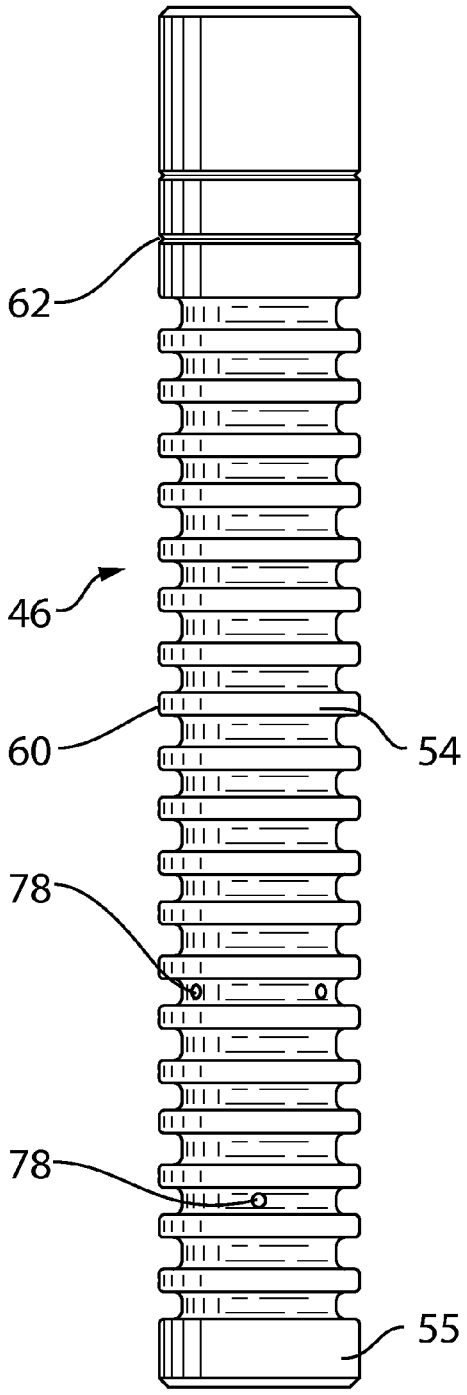
FIG. 2 is a side view of an embodiment of a plunger according to the invention.

With reference to FIG. 2, in one embodiment plunger 46 has an elongated body 54. Plunger 46 is preferably made from metallic materials such as steel, titanium or the like, and portions of plunger 46 may be made from two or more different types of such materials. In some embodiments, at least a portion of plunger 46 is made from a magnetic material, which may facilitate retrieval of plunger 46 or detection of plunger 46 arriving at the surface 22.

Heavy plungers operated at higher speeds have a significant amount of kinetic energy, and can cause damage to equipment used in well 20. For example, the force of plunger 46 arriving at the surface 22 may damage lubricator 32 if the plunger has more kinetic energy than lubricator 32 can safely dissipate when catching plunger 46.

In some embodiments wherein plunger 46 is approximately 25 cm long and has a diameter of approximately 5 cm, plunger 46 may have a weight of less than four pounds (i.e. approximately 1.8 kg), for example approximately two pounds (i.e. approximately 0.9 kg). In some embodiments, a majority of the material from which plunger 46 is constructed (measured by volume) may be a material having a density of 4.54 g/cm$^3$ or less. A plunger having a lower weight will have less kinetic energy during operation at the same speed as a heavier plunger, which aids in decreasing the impact of the plunger when it arrives at the surface 22 or bottom of well 20. Thus, a lighter plunger may be safely operated at higher velocities than an equivalent heavy plunger. Operation of a plunger lift at higher frequency to lift smaller volumes of liquid can be more efficient than lifting larger amounts of liquid less frequently.

In some embodiments, a plunger having a weight of five pounds (i.e. approximately 2.3 kg) or less is operated to travel in tubing 30 at maximum speeds of at least 800 feet per minute (i.e. approximately 4 metres per second). In some such embodiments, the lifting and falling of plunger 46 may be repeated at a frequency of up to 6 times per hour depending on the depth of well 20.

In some embodiments, the bottom 55 of plunger body 54 may be slightly tapered or cone-shaped, which may facilitate descent of plunger 46.

The outer surface 60 of plunger body 54 may be configured in a manner effective to provide the desired level of sealing with tubing 30 depending on the conditions prevailing in well 20. As used herein, "sealingly engages" means that the plunger seals against tubing 30 sufficiently well to perform artificial lift of liquids. A complete seal is not required to perform artificial lift, and the passage of small amounts of gas and/or liquid between the plunger and the tubing is not detrimental and can be beneficial.

In the illustrated embodiment, plunger body 54 has a series of axially spaced ribs 56 defining grooves 58 therebetween on its outer surface 60. The combination of ribs and grooves may create turbulence in any fluid that passes between plunger 46 and the inner surface of production tubing 30. Such turbulence may improve the ability of plunger 46 to maintain a seal and act effectively as a piston. Alternatively, plunger 46 may have other surface characteristics known for use on plungers to accommodate a variety of different operating conditions, such as solid rings, shifting rings, spring loaded interlocking pads, a spiral-wound brush surface, or the like.

Outer surface 60 may also incorporate one or more monitoring grooves 62, or other markings or indicia on the surface, to indicate wear. Such markings may be observed by an operator, who may periodically remove plunger 46 for inspection to determine if plunger 46 is worn to a point where replacement may be recommended. Outer surface 60 may also be provided with catching grooves 61, to facilitate capture of plunger 46 at the surface 22 of well 20 by a mechanism such as a ball detent (not shown) within lubricator 32.

Figure 3:
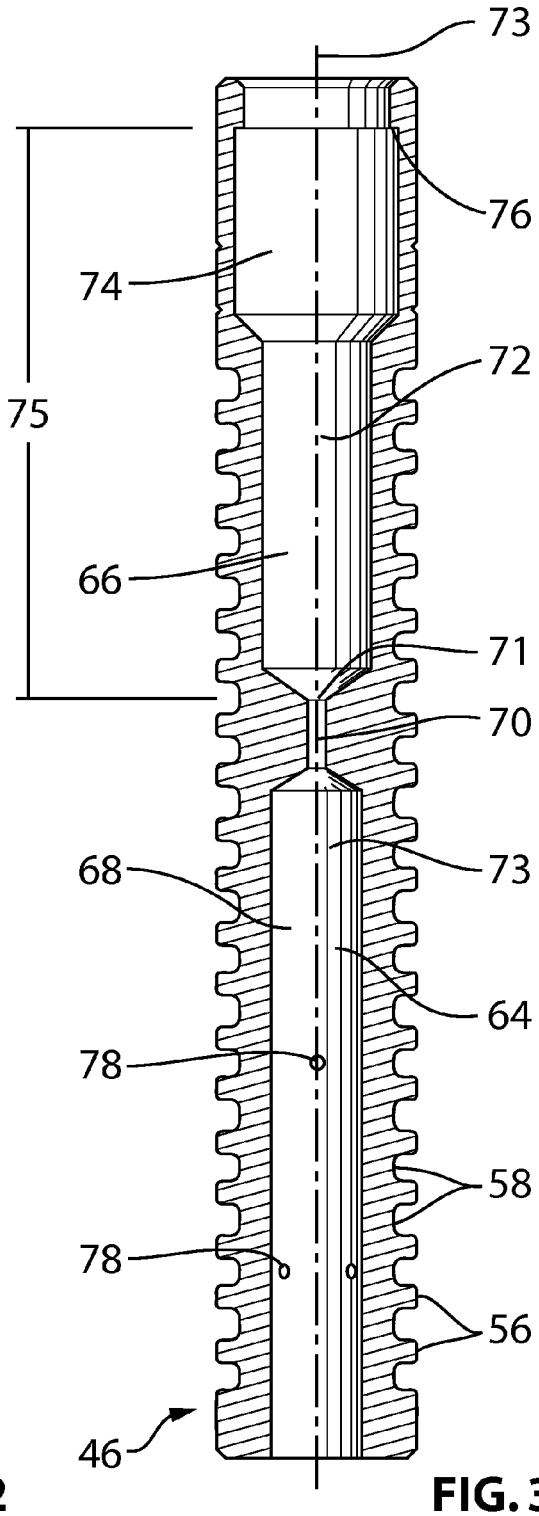
FIG. 3 is a cross-sectional view of the embodiment of FIG. 2.

With reference to FIG. 3, plunger body 54 defines a fluid path through a bore 64 of plunger 46. In the illustrated embodiment, bore 64 has an upper chamber 66, a lower chamber 68, and a connecting passageway 70. As used in this specification, "upper" means the portion of plunger 46 that is oriented towards the surface 22 of well 20 when plunger 46 is in use, and "lower" means the portion of plunger 46 that is oriented towards the bottom of well 20 when plunger 46 is in use. "Inwardly" means a direction towards the central axis of well 20, and "outwardly" means a direction towards casing 26 of well 20. It will be appreciated that plunger 46 could have other orientations when not in use.

Figure 7:
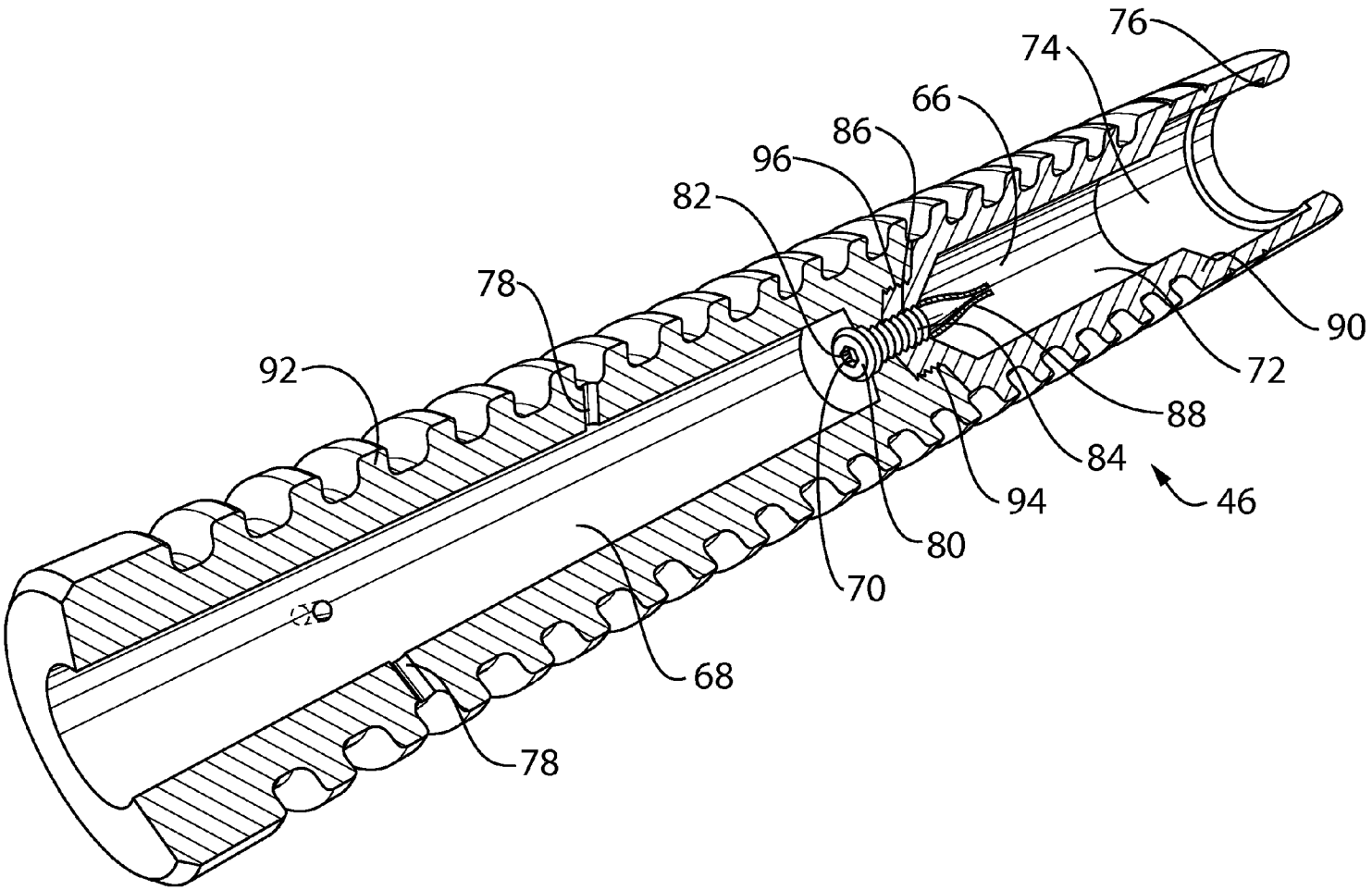
FIG. 7 is a perspective partially cut away view of a further embodiment of a plunger constructed as two separate pieces that are detachably joined. The embodiment of FIG. 7 also includes a one-way valve disposed therein to permit fluid to flow only from the lower chamber to the upper chamber.

Connecting passageway 70 is narrower than chambers 66 and 68 and has an upper orifice 71 at its upper end. Upper orifice 71 may be provided for example by a plug with a hole therethrough. The plug may be removable, for example by being threadably engaged within connecting passageway 70. In the embodiment of FIG. 7, upper orifice 71 is provided by a hex plug 80 that is threadably engaged with a correspondingly threaded surface on connecting passageway 70. The plug may be made of steel or another suitable material.

In the embodiment illustrated in FIG. 3, connecting passageway 70 is cylindrical, and both passageway 70 and upper orifice 71 are concentric with chambers 66 and 68 and with the central longitudinal axis 73 of plunger 46 (i.e. upper orifice 71 is centrally located). In this embodiment, all of connecting passageway 70, upper orifice 71, and chambers 66 and 68 have a circular cross-section. Passageway 70 and upper orifice 71 are narrower than chambers 66 and 68. Chambers 66 and 68 may have different widths, or may have the same width.

The diameter of connecting passageway 70 and orifice 71 may be selected to be wider or narrower based on the particular operating characteristics of well 20 (as described below). Suitable ratios of the diameter of orifice 71 to the diameter of plunger 46 may range from about 1:25 to 1:2.5 (i.e. the diameter of orifice 71 may be in the range of 4% to 40% of the diameter of plunger 46). For example, in embodiments where plunger 46 has a diameter of approximately 4.9 cm, orifice 71 may be in the range of about 2 mm to about 20 mm in diameter. In some such embodiments, orifice 71 may have a diameter of approximately 4.7 mm in a well operating at typical pressure, or approximately 6.0 mm, approximately 8.0 mm, or approximately 10.0 mm in diameter if the well is operating at higher pressure (i.e. to provide a ratio of the diameter of orifice 71 to the diameter of plunger 46 of approximately 1:10, 1:8, 1:6 or 1:5, respectively).

In some embodiments, alternative configurations for connecting passageway 70 may be used. For example, in the embodiment illustrated as plunger 46B in FIG. 4, the fluid pathway between lower chamber 68 and upper chamber 66 is provided by a pair of connecting channels 77 that are narrower than chambers 66 and 68 and join together at their upper ends to permit fluid to flow through upper orifice 71. Upper orifice 71 is centrally located.

Upper chamber 66 is provided with a radially inwardly directed lip 76 spaced upwardly apart from the upper edge of connecting passageway 70 by a distance 75. Lip 76 is shown in the illustrated embodiment as being on the upper edge of upper chamber 66, although lip 76 could be placed within upper chamber 66. Distance 75 is sufficient to allow fluid discharged through connecting passageway 70 to interact with lip 76. Distance 75 may, for example, be in the range of approximately 10% to approximately 60% of the total length of plunger 46. For example, in an embodiment wherein plunger 46 is approximately 25 cm long, distance 75 may be approximately 13 cm.

Lip 76 extends radially inwardly for a sufficient distance and has a suitable configuration (e.g. generally perpendicular to the inner surface of bore 64) to enable lip 76 to interact with the fluid flow being discharged through connecting passageway 70 when plunger 46 is being forced upwardly within well 20 (as described below). However, lip 76 does not extend so far inwardly as to significantly impede the flow of fluid through bore 64 of plunger 46 during operation.

Figure 4:
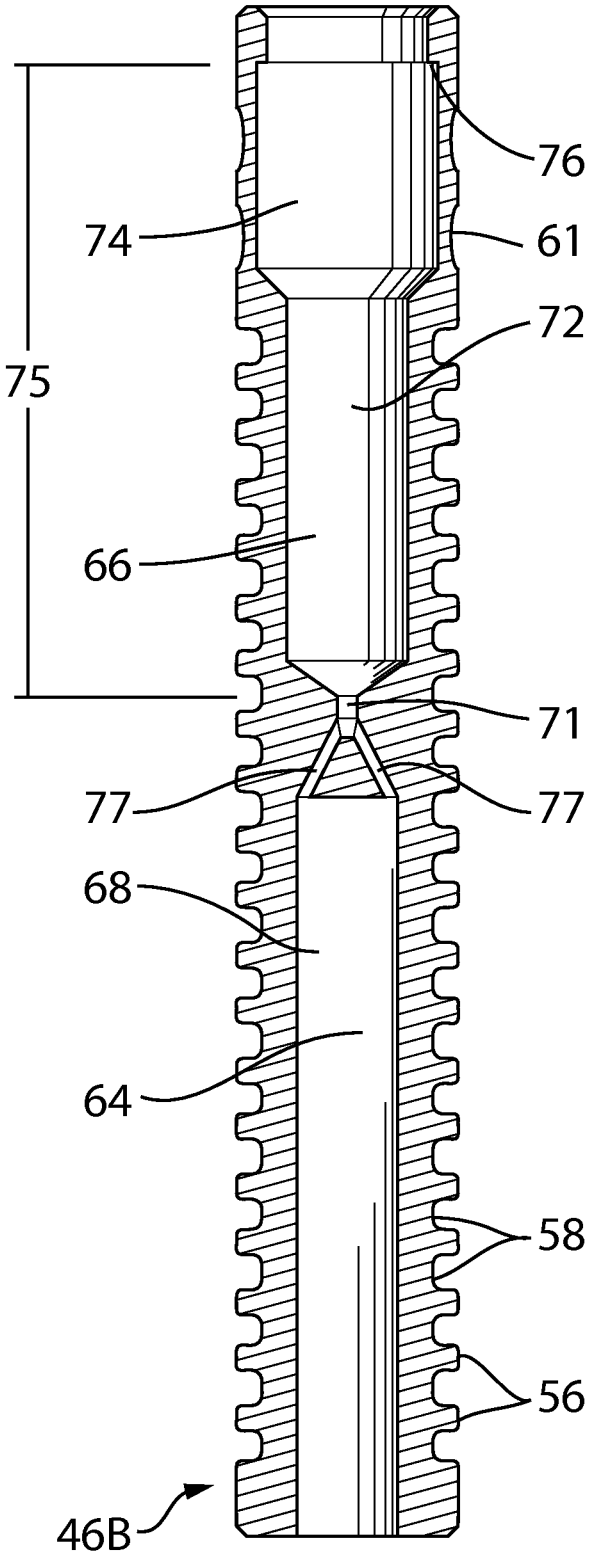
FIG. 4 is a cross-sectional view of an alternative embodiment of a plunger having an alternative configuration of the connecting passageway.

In the illustrated embodiment of FIGS. 3 and 4, upper chamber 66 is divided into two portions, 72 and 74. Portion 74 of upper chamber 66 provides an internal-type fishing neck for use with a conventional plunger pulling tool (not shown). A plunger pulling tool can be used to return plunger 46 to the surface 22 by wireline recovery should plunger 46 fail to rise to the surface. Lip 76 may project inwardly by approximately 0.3 cm in such an embodiment.

Figure 5:
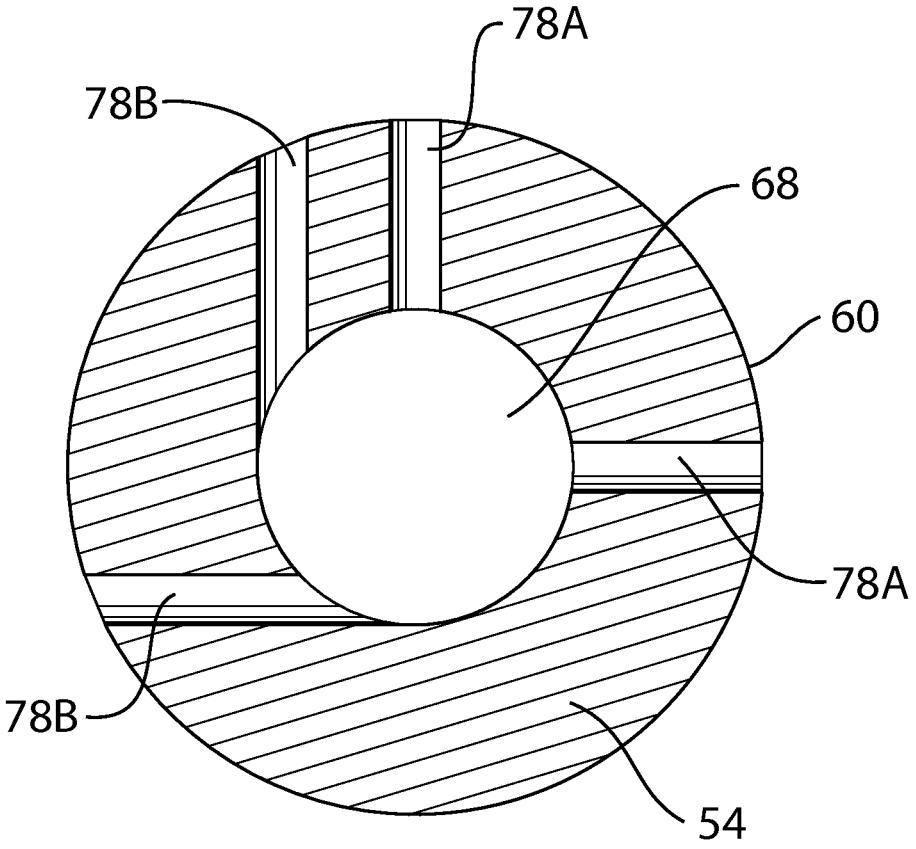
FIG. 5 is a cross-sectional view of an embodiment of a plunger having fluid passageways within its lower chamber.

Lower chamber 68 may optionally incorporate one or more additional fluid passageways 78 that connect lower chamber 68 to the outer surface 60 of plunger 46 and allow fluid to flow between lower chamber 68 and the interior of tubing 30. As shown in FIG. 5, in some embodiments, fluid passageways 78 may intersect lower chamber 68 radially (78A) or tangentially (78B). Fluid passageways 78 may allow plunger 46 to descend more quickly within well 20, and may permit some gas to pass between plunger 46 and tubing 30, to decrease friction therebetween.

During the portion of the well operating cycle when control valve 36 is in the closed position and the flow of gas and liquid through the system has stopped, the pressure will fall within tubing 30. Chambers 66 and 68 together with connecting passageway 70 provide a fluid path through plunger 46, allowing gas and liquid to pass through the interior of elongated plunger body 54. Such fluid flow allows for a faster rate of descent of plunger 46 than would be the case if the plunger were formed as a solid body or without a fluid path therethrough. Thus, a lighter plunger, which will have a lower risk of causing damage to the components of well 20, may be operated at the same frequency as a heavier plunger that does not have a fluid path therethrough. Fluid passageways 78 further assist in achieving relatively fast descent. The faster rate of descent can be achieved without the use of special valves or any moving components to alter or regulate the rate of descent.

When the well cycle is changed by control system 42 to open control valve 36, plunger 46 will be affected by the flow of gas from the high pressure accumulated in annulus 52 to the low pressure at the exit point of the well system, where the fluid moves on to the next stage of collection, designated by arrow 38. Fluid will enter lower chamber 68 and encounter resistance as it enters connecting passageway 70, thereby exerting some upward force on plunger 46.

Without being limited by any theory of operation, the narrow connecting passageway 70 is thought to create a venturi effect whereby gas flow effects a change in velocity of the fluid (which is increased), and the pressure of the fluid flow is decreased within connecting passageway 70. The fluid flow through connecting passageway 70 will occur at an accelerated velocity and lower pressure as compared to the velocity of the fluid flow in lower chamber 68. The resultant low pressure jet of fluid exits through upper orifice 71, thereby providing a lower pressure above plunger 46. This effect and the resulting positive differential pressure between lower chamber 68 and the region above plunger 46 create an upward force affecting the entire plunger 46. The resultant lift effect on plunger 46 improves its ability to move liquid and gas load carried above it to the surface 22.

The fluid flowing into upper chamber 66 through connecting passageway 70 and upper orifice 71 interacts with lip 76, exiting upper orifice 71 at increased velocity, expanding radially outwardly in a V-shape, and impacting against lip 76. This effect provides additional upward force on plunger 46. Fluid exiting connecting passageway 70 fans outwardly generally with a V-shape from orifice 71 on the central axis of plunger 46 toward lip 76, and accordingly distance 75 should be sufficiently large and lip 76 should project inwardly to an extent sufficient to allow the exiting fluid to interact with lip 76.

The fluid path through plunger 46 and resultant turbulent flow of fluid from lower chamber 68 through connecting passageway 70 and into upper chamber 66 also cleans upper chamber 66 of debris, such as sand, salt, paraffin or scale, all of which are common elements found in a well operation. This maintains the functionality of the venturi effect and keeps internal fishing neck 74 clear and accessible for retrieval of plunger 46 by a wireline (not shown), should this become necessary.

Figure 6:
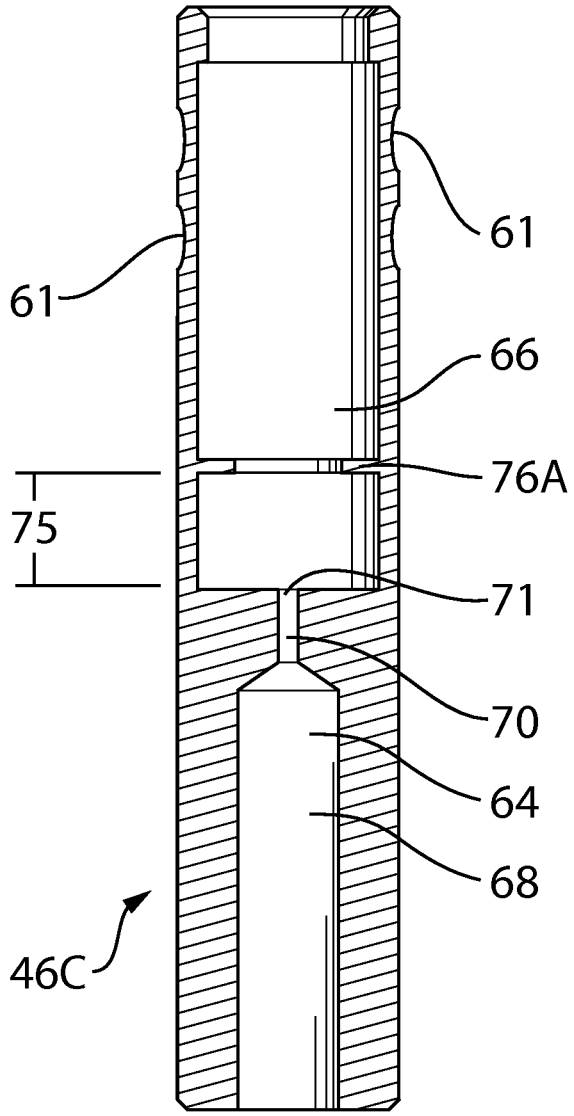
FIG. 6 is a cross-sectional view of an alternative embodiment of a plunger having an internal lip.

FIG. 6 illustrates an alternative embodiment of a plunger 46C in which an internal lip 76A is provided within upper chamber 66 spaced apart from upper orifice 71 by distance 75. A conventional internal-type fishing neck is provided at the upper end of plunger 46C, and internal lip 76A is spaced sufficiently below the internal-type fishing neck that it will not interfere with the use of a conventional plunger pulling tool to retrieve plunger 46C.

In another embodiment, illustrated in FIG. 7, a removably fastened size-modifying insert, illustrated as screw plug 80, is provided within connecting passageway 70 to fluidly connect chambers 66 and 68. In the illustrated embodiment, at least a portion of screw plug 80 has a threaded outer surface 84, which is engageable with a correspondingly threaded surface 86 of connecting passageway 70. The size-modifying insert could alternatively be removably fastened in any suitable manner, such as by a friction fit engagement. The size-modifying insert has a narrow bore 82 extending therethrough to permit the opening in connecting passageway 70 to be changed to be narrower by providing a bore of a somewhat smaller diameter therein.

It may be necessary or desirable to provide a narrower bore, for example based on the conditions under which plunger 46 is operating, the velocity at which it is desired to operate plunger 46, or the weight of plunger 46. For example, in a well with a lower pressure of flow, for a heavier plunger, or where a faster operating velocity is desired, a narrower bore would be used, for example wherein the ratio of the diameter of orifice 71 to the diameter of plunger 46 is approximately 1:10 or 1:25. A wider bore wherein the ratio of the diameter of orifice 71 to the diameter of plunger 46 is approximately 1:8, 1:6, 1:5, or 1:2.5 may also be provided, for example.

A plurality of different screw plugs having a range of differently sized bores 82 may be provided for use with plunger 46, so that an appropriate screw plug can be inserted in plunger 46 to adjust the width of connecting passageway 70. Plunger 46 may optionally be provided in a kit with two or more size-modifying inserts, such as screw plugs 82, having different bore diameters.

In a further embodiment, illustrated in FIG. 7, a suitable one-way valve 86 such as a duck bill valve or the like may be arranged on or within connecting passageway 70, to ensure that fluid flows only from lower chamber 68 to the upper chamber 66 of plunger 46. For example, one-way valve 86 could be coupled to screw plug 80 as illustrated (e.g. at the upper end of screw plug 80), or to the internal surface of plunger body 54.

In a further embodiment, plunger 46 may be constructed as two separate pieces that are joined in a suitable manner. In the embodiment shown in FIG. 7, an upper portion 90 of plunger 46 is detachably coupled to a lower portion 92 of plunger 46 by means of a screw-threaded engagement of corresponding threaded surfaces 94 (on lower portion 92) and 96 (on upper portion 90). Such a configuration facilitates access for changing screw plug 80 and/or one-way valve 88 by permitting the two portions of plunger 46 to be separated.

In some embodiments, upper and lower portions 90 and 92 of plunger 46 may be manufactured from different materials. For example, a relatively light material such as titanium may be used to manufacture lower portion 92 to reduce the mass of plunger 46, while steel may be used to manufacture upper portion 90, to permit detection of plunger 46 by a magnetic sensor (for example shown schematically as sensor 98 in FIG. 1), which may be used to detect the arrival of plunger 46 at the surface 22.

In some embodiments, one or more instruments used for measuring certain operating parameters of well 20, for example an instrument for measuring temperature or pressure, may be carried by plunger 46. In exemplary embodiments, such instruments may be secured within lower chamber 68 of plunger 46 to record operating parameters within well 20, for example at the bottom of well 20. The instruments may be secured within lower chamber 68 in any suitable manner, for example on threaded surface 86 of connecting passageway 70. The instrument may comprise a memory capable of recording the operating parameters so measured. The memory may also be secured within lower chamber 68, and may optionally log the measured parameters for a period of time. An operator may retrieve information about the measured operating parameters by accessing lower chamber 68 when plunger 64 has been returned to the surface 22 of well 20 and removed through lubricator 32, for example during routine inspection of plunger 46 or at other desired intervals.

In a further exemplary embodiment having a bypass valve, illustrated as plunger 300 in FIGS. 8A to 9B, a bypass valve 302 is provided to permit plunger 300 to descend in well 20 when well 20 is flowing. Bypass valve 302 is in the open position when plunger 300 is falling downwardly within well 20 to permit fluid to flow therethrough and facilitate rapid descent of plunger 300, and in the closed position when plunger 346 is ascending within well 20 to limit fluid flow through plunger 300 and permit plunger 346 to be lifted upwardly by gas pressure within well 20.

In the illustrated embodiment, bypass valve 302 has a cage 304 with a pin 306 inserted therein. Bypass valve 302 is secured to the bottom 308 of plunger 300. In the illustrated embodiment, a bottom portion of outer surface 310 of plunger body 312 is a threaded portion 314, and engages with a correspondingly threaded surface 316 on an inner surface of the upper portion of cage 304. A fluid path 317 is provided through cage 304 from the bottom 308 of plunger 300 to the top 318 of plunger 300.

Cage 304 has an axially extending bore 320 defined therethrough. Bore 320 has a relatively wider upper portion 322 and a relatively narrower lower portion 324. Cage 304 may have at least one axially extending slot 326 on the outside surface of the lower portion thereof, extending from base 320 of cage 304 upwardly to a point above narrower portion 316. At least one aperture 328 is provided in cage 304 through wider upper portion 322 of bore 320 to provide a fluid path therethrough. Aperture 328 may be formed by the intersection of slot 326 and wider upper portion 322. In the illustrated embodiment, three symmetrically disposed slots 326 and apertures 328 are provided. Slot 326 does not extend fully through the material of cage 304 where slot 326 intersects narrower portion 324 of bore 320 in the illustrated embodiment, although it optionally could do so.

To enhance the coupling between cage 304 and plunger body 312, an aperture 330 may be provided through threaded portion 316 of cage 304 to optionally receive a setscrew or weld plug (not shown).

A pin 306 is slidably disposed within bore 320 of cage 304. Pin 306 has an elongate shaft portion 332 and a wider head portion 334. Head portion 334 is disposed within wider upper portion 322 of bore 320 and is slidable in an axial direction therein. The diameter of head portion 334 is sufficiently large so that pin 306 cannot slide through lower portion 324 of bore 320, and also so that pin 306 can seal against plunger body 312 as described below. Upper portion 336 of pin 306 makes contact with an inner lip 338 on the inner surface of the bottom 308 of plunger body 312 when bypass valve 302 is in the closed position, to limit passage of gas and fluid between pin 306 and plunger body 312. Upper portion 336 may have an angled portion 340 that contacts a correspondingly shaped angled portion of inner lip 338.

Shaft portion 332 of pin 306 sits within bore 320 and projects downwardly from head portion 326. The bottom end 339 of pin 306 extends outside of the bottom 341 of cage 304 when bypass valve 302 is in the open position, and is sufficiently long to move head portion 334 into the fully closed position when pin 306 contacts bottom-hole stop 48 as described below.

Head portion 334 is configured to permit a desired amount of gas or liquid to pass through pin 306 when bypass valve 302 is in the closed position by including a fluid path therethrough. The fluid path may extend through or into shaft portion 332, so long as it is positioned to permit fluid flow therethrough when pin 306 is in the closed position. In the illustrated embodiment, head portion 334 has three symmetrically disposed cylindrical fluid paths 342 extending between lower edge 344 and upper edge 336 of head portion 334. Other configurations for the fluid path may be used. Fluid paths 342 join at a central orifice 346 of pin 306 which is concentric with a central axis 348 of plunger 300. Fluid paths 342 allow a desired amount of fluid to pass through bypass valve 302 even when bypass valve 302 is in the closed position, thus providing a venturi effect through central orifice 346 as described above with reference to orifice 71. Fluid flow through orifice 346 also keeps bypass valve 302 free of debris such as sand, salt, paraffin or scale, enabling pin 306 to slide within cage 304 (as described below) without obstruction by such debris.

Figure 10:
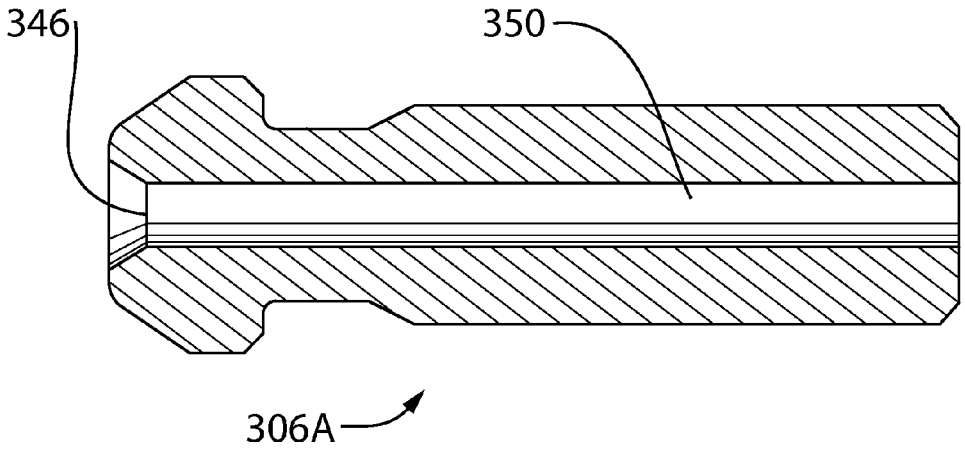
FIG. 10 is a cross-sectional view of an alternative embodiment of a pin portion of a bypass valve that is used with the embodiment of FIG. 8A.

As an example of an alternative fluid path configuration within pin 306, the fluid path could be provided by a single central bore through the entirety of the length of pin 306 leading to central orifice 346, illustrated as bore 350 in pin 306A in FIG. 10.

In the case of plunger 300, when bypass valve 302 is in the closed position, gas and liquid under pressure in annulus 52 will enter lower chamber 350 of plunger 300, encountering resistance as it enters fluid paths 342, thereby exerting an upward force on plunger 300. Narrow fluid paths 342 also create a venturi effect as described with reference to connecting passageway 70 above. Connecting passageway 70 is not present in plunger 300. The fluid flow through fluid paths 342 will occur at an accelerated velocity as compared with the rate of fluid flow through bore 320 of cage 304 and the rate of fluid flow through plunger body 312. The pressure of fluid exiting through orifice 346 is thus reduced, which decreases the pressure above plunger 300.

Fluid exits orifice 346 and fans outwardly generally with a V-shape from the central axis 348 of plunger 300 and encounters lip 352 of lower chamber 350 of plunger 300. Lip 352 is spaced apart from orifice 346 by a distance 354, which is sufficiently large to allow the fluid exiting orifice 346 to interact with lip 352, and has a configuration suitable for allowing fluid to apply upward force against lip 352 (e.g. lip 352 may be generally perpendicular to the inner surface of plunger body 312). For example, distance 354 may be in the range of 10% to 50% of the length of plunger body 312.

Figure 11:
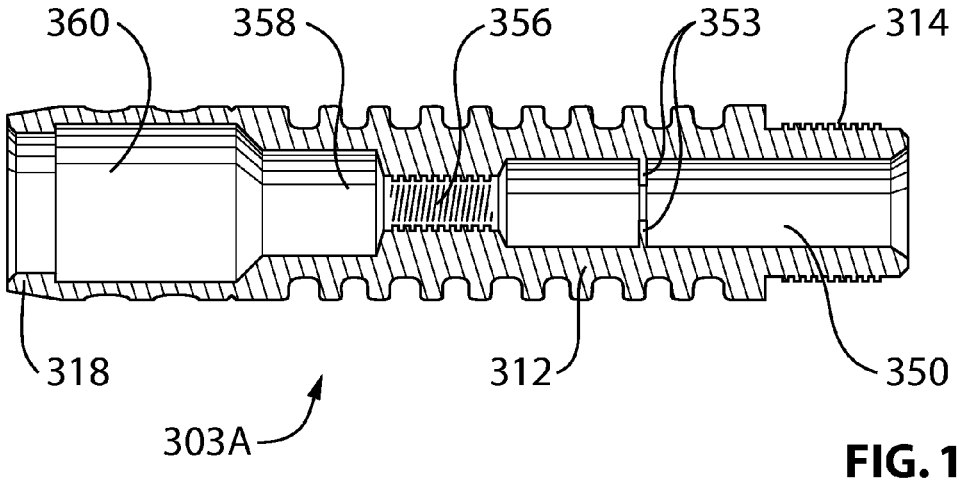
FIG. 11 is a cross-sectional view of a plunger body of a further embodiment of a plunger according to the invention having a bypass valve wherein the lip is provided separately from the internal constriction of the plunger body.

In the illustrated embodiment of FIG. 8A, lip 352 is provided by the lower edge of the internal constriction formed where fluid path 317 narrows into bore 356, described below. However, as illustrated in FIG. 11, a lip may alternatively be provided as a separate member 353 on plunger 300A.

Plunger 300 functions in a manner generally similar to plunger 46. Bypass valve 302 allows plunger 300 to fall even while well 20 is flowing, meaning well 20 does not need to be shut in while plunger 300 is falling. In operation, bypass valve 302 is placed into the closed position (shown in FIG. 8B) when bottom end 339 of pin 306 contacts bottom-hole stop 48 when plunger 300 has descended to the bottom of well 20. Movement of pin 306 upwardly relative to cage 304 places head portion 334 in contact with inner lip 338 of plunger body 312. The force of the gas pressure within tubing 30 against the lower side of head portion 334 holds pin 306 in the closed position. Fluid paths 342 are narrow enough that sufficient force is maintained against the lower side of head portion 344 by the pressure of gas and fluid within tubing 30 to hold pin 306 in the closed position. Plunger 300 then rises to the surface 22 as described above by reason of the upward force applied to plunger 300 by the fluid pressure in tubing 30.

When plunger 300 reaches the surface 22, it should rise sufficiently far into lubricator 32 that the entirety of plunger 300, including bypass valve 302, is above exit tubing 34. The gas pressure against the lower side of head portion 334 is thus released as gas and liquid are permitted to exit well 20 via exit tubing 34, and pin 306 drops within cage 304 into the open position (shown in FIG. 8C) by gravitational force. This facilitates the descent of plunger 300, even while well 20 is flowing. The use of gas pressure to keep pin 306 in the closed position and gravitational force/release of gas pressure to move pin 306 into the open position means no additional parts or mechanisms are required to operate bypass valve 302.

To better control the rate of descent of plunger 300, an internal constriction is provided within fluid path 317. The internal constriction slows the rate of descent of plunger 300 when bypass valve 302 is open. In the illustrated embodiment, bore 356 provides the internal constriction within plunger 300. Bore 356 may be threaded to receive inserts having passageways of varying widths therethrough to allow selection of an appropriate diameter for bore 356 depending on the conditions prevailing in well 20. In some embodiments, the insert may be a screw plug. A plurality of screw plugs having diameters of varying widths may be provided in a kit with plunger 300.

Figure 8A:
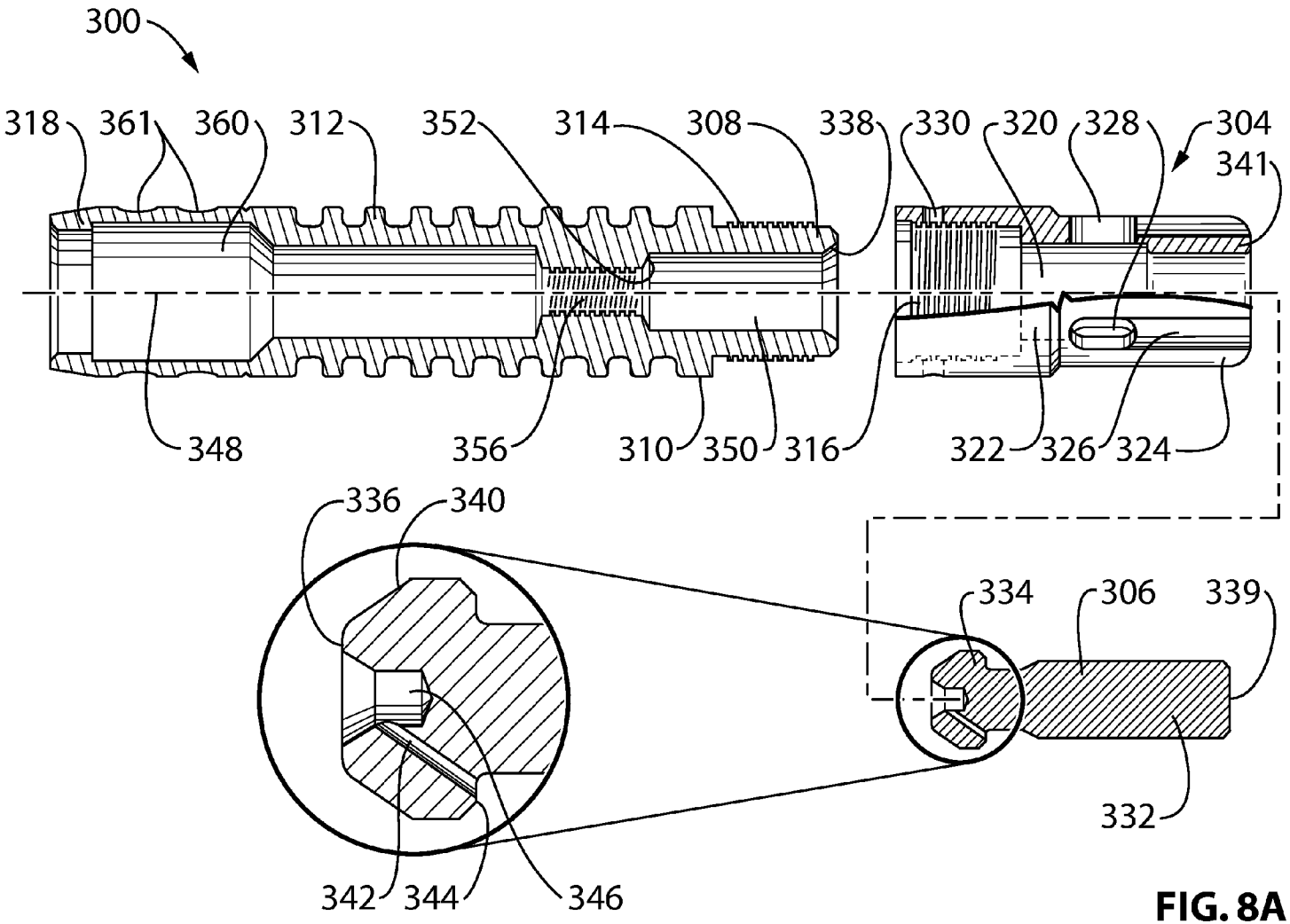
FIG. 8A is an exploded cross-sectional view of a further embodiment of a plunger according to the invention having a bypass valve.
Figure 8B:
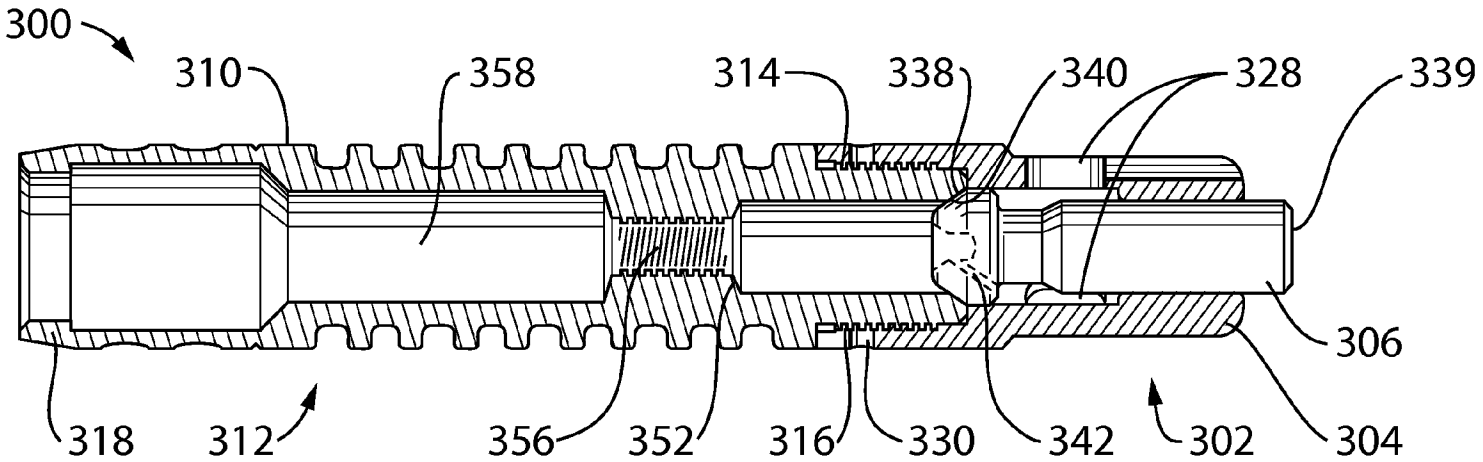
FIG. 8B is a cross-sectional view of the plunger of FIG. 8A in the closed position.
Figure 8C:
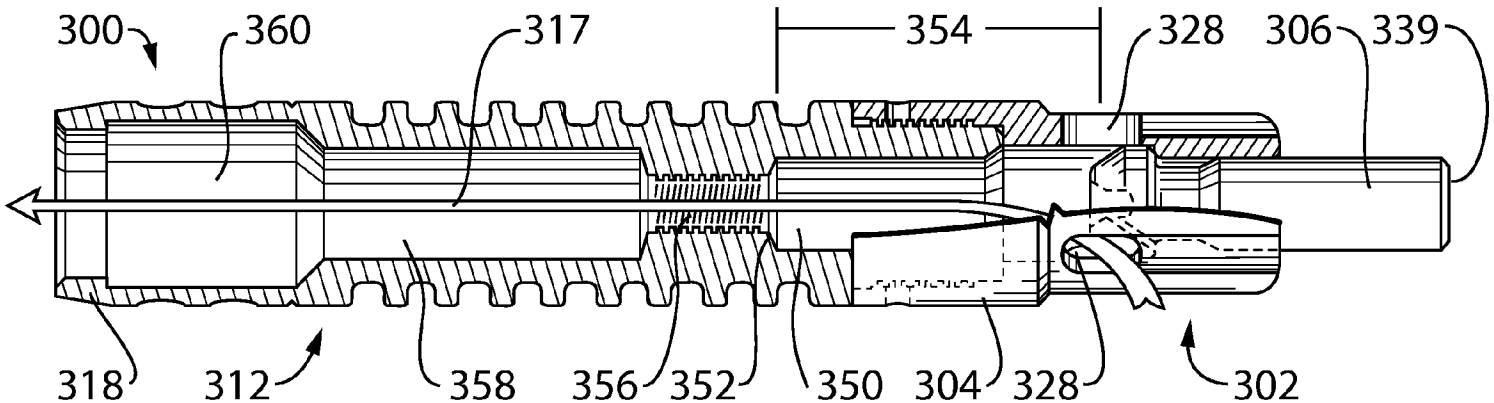
FIG. 8C is a cross-sectional view of the plunger of FIG. 8A in the open position.
Figure 9A:
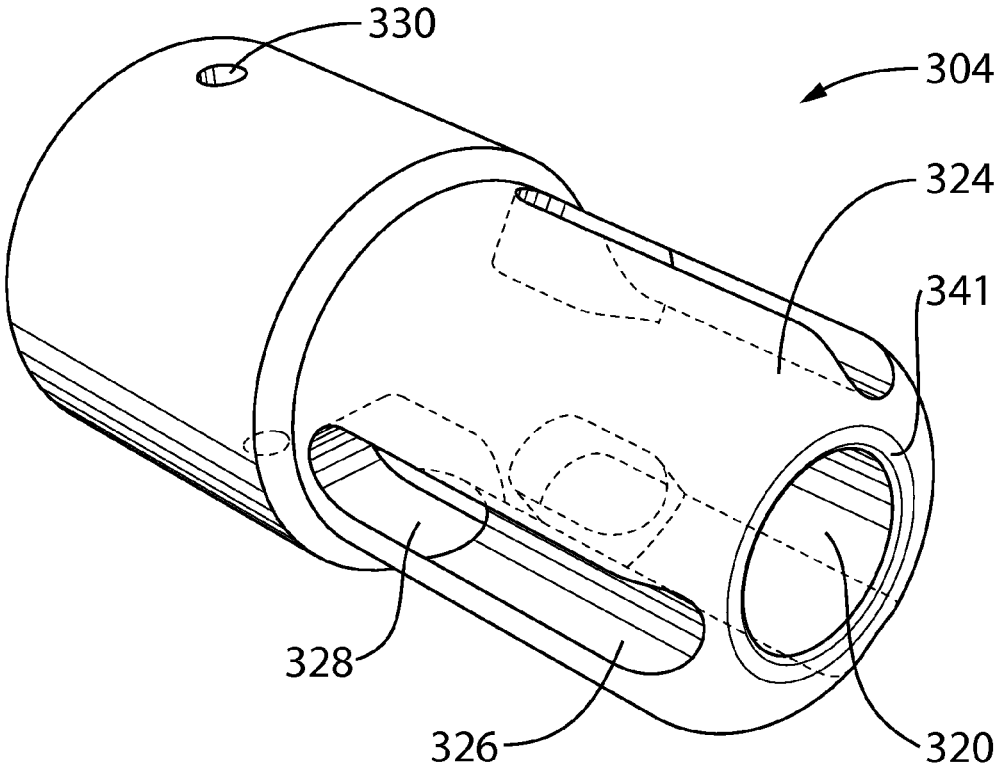
FIG. 9A is a perspective view of the cage portion of the bypass valve of the embodiment of FIG. 8A.
Figure 9B:
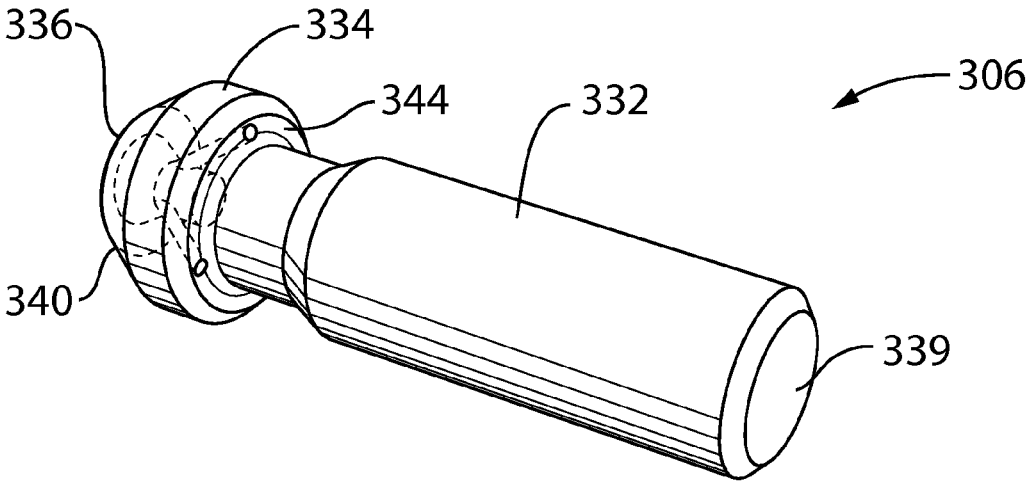
FIG. 9B is a perspective view of the pin portion of a bypass valve that of the embodiment of FIG. 8A.

In the illustrated embodiment of FIGS. 8A to 8C, plunger body 312 has an upper chamber 358 that is divided into two portions, the upper portion being an internal-type fishing neck 360. Fishing neck 360 allows for retrieval of plunger 300 by conventional wireline methods, as described above for plunger 46. Other upper chamber configurations may be used for plunger 300.

Plunger 300, including bypass valve 302 is made from a metallic material. In some embodiments, all or a portion of bypass valve 302 is made from a magnetic material such as steel to facilitate detection of bypass valve 302 by a magnetic arrival sensor upon arrival within lubricator 32. Other portions of plunger 300 may be made from other metallic materials. In some embodiments, plunger body 312 is made from non-magnetic material such as titanium while at least a portion of bypass valve 302 is made from a magnetic material such as steel so that magnetic arrival sensor 98 is not triggered until bypass valve 302 arrives at magnetic arrival sensor 98. Because pin 306 falls into the open position by gravitational force when the upward force applied by fluid pressure within tubing 30 is released, bypass valve 302 must fully pass exit tubing 34 when plunger 300 arrives at surface 22 to ensure reliable functioning of plunger 300. Forming at least a portion of bypass valve 302 from a magnetic material while other portions of plunger 300 are formed from non-magnetic material facilitates reliable detection of the fact that plunger 346 has been received properly within lubricator 32. If plunger 300 is not properly received, as indicated for example by a failure to trigger magnetic arrival sensor 98, an operator may take appropriate corrective action, for example by briefly shutting in well 20.

Figure 12:
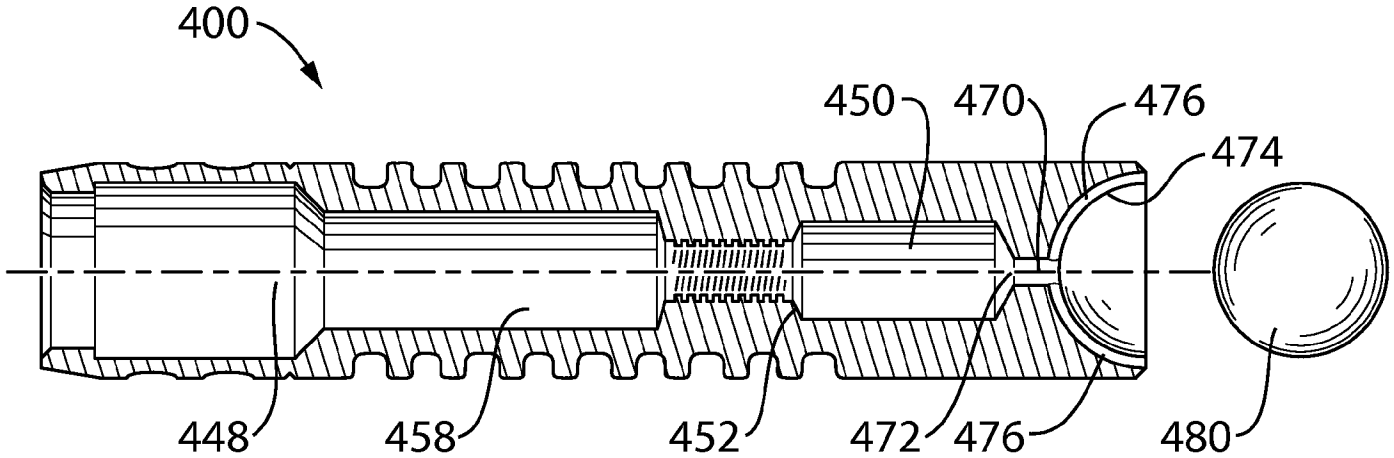
FIG. 12 is a cross-sectional view of a further embodiment of a plunger according to the invention having a bypass valve, wherein the plunger is a two piece Pacemaker™-type plunger and the valve seat has grooves to permit a limited amount of fluid to flow between the valve seat and the ball.

In other embodiments, a different type of bypass valve may be used with the plunger. For example, a valve of the type found in Pacemaker™ two-piece plungers may be used. Such plungers have a seat on their lower ends. A separate ball is dropped into the well tubing ahead of the plunger. The ball can seal against the seat. In an exemplary embodiment illustrated as plunger 400 in FIG. 12, plunger 400, which is generally similar in design and function to plunger 300, includes a fluid passageway 470, an orifice 472 at an upper end of fluid passageway 470, a lower chamber 450 in fluid communication with orifice 472, an upper chamber 458, and a lip 452 between lower chamber 450 and upper chamber 458. At its lower end, plunger 400 has a curved seat 474 for receiving a ball seal 480. Seat 474 includes grooves 476. When ball 480 is engaged with seat 474, grooves 476 define a fluid passageway between ball 480 and plunger 400. When plunger 400 is falling, ball 480 falls separately from plunger 400, allowing fluid to flow rapidly through plunger 400. When plunger 400 reaches bottom hole stop 48, ball 480 is engaged with seat 474, and the force of gas pressure within tubing 30 holds ball 480 against seat 474. Grooves 476 permit fluid to flow between seat 474 and ball 480 into fluid passageway 470 and through orifice 472, thus providing a venturi effect as described above with reference to orifice 71 and central orifice 346. Fluid enters lower chamber 450, engages with lip 452 as described above with reference to lip 352, and passes into upper chamber 458 where it can exit plunger 400 (i.e. fluid can travel through a fluid path in the body of plunger 400). Fluid passageway 470 and orifice 472 may be concentric with a central axis 448 of plunger 400.

Using similar principles, valves having valve members of alternative shapes may be used. The valve member and/or a valve seat against which the valve member can engage may be grooved or textured so that when the valve is "closed" with the valve member against the seat, a desired amount of fluid is allowed to pass into the plunger body to provide a venturi effect as described above. Alternatively, as described for example with reference to plunger 300, a fluid passageway may be provided through a valve member of alternative shape to allow a desired amount of fluid to pass into the plunger body to provide a venturi effect as described above.

Figure 13:
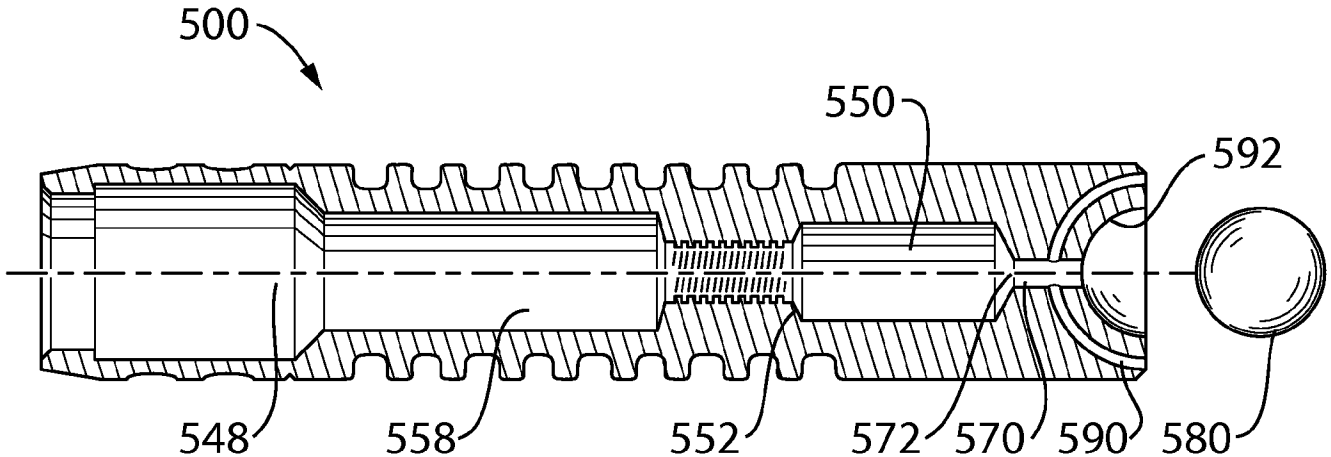
FIG. 13 is a cross-sectional view of a further embodiment of a plunger according to the invention having a bypass valve, wherein the plunger is a two piece Pacemaker™-type plunger and the plunger body includes fluid passageways that permit a limited amount of fluid to flow through the body of the plunger when the ball is engaged with the valve seat.

In other embodiments having a bypass valve, fluid channels allowing fluid to flow through the body of the plunger itself when the bypass valve is in the closed configuration may be used. The fluid channels can allow fluid to flow through an orifice of the plunger body to provide a venturi effect when the bypass valve is in the closed configuration. For example, in the embodiment illustrated as plunger 500 in FIG. 13, a pair of fluid channels 590 are formed in the bottom of plunger 500. Fluid channels 590 are configured to allow fluid to flow through the body of plunger 500 even when the bypass valve, illustrated as a Pacemaker™-type two-piece plunger system in FIG. 13, is in the closed position. Plunger 500 is generally similar in design and function to plunger 400, and includes a fluid passageway 570, an orifice 572 at an upper end of fluid passageway 570, a lower chamber 550 in fluid communication with orifice 572, an upper chamber 558, with a lip 552 between lower chamber 550 and upper chamber 558. At its lower end, plunger 500 has a curved seat 592 for receiving a ball 480. Plunger 500 operates in a generally similar manner to plunger 400, except that fluid flows into fluid passageway 570 and orifice 572 through fluid channels 590 when ball 580 is engaged with seat 592 when plunger 500 is travelling upwardly within well 20. Orifice 572 and fluid passageway 570 may be concentric with the central axis 548 of plunger 500. The configuration of fluid channels 590 is not critical, so long as fluid channels 590 permit a desired amount of fluid to flow through orifice 572 when ball 580 is engaged with seat 592, thereby providing a fluid path through plunger 500 to orifice 572.

While a number of exemplary aspects and embodiments have been discussed above, those of skill in the art will recognize certain modifications, permutations, additions and sub-combinations thereof. For example:

- a removable size-modifying insert such as screw plug 80 could be engaged within connecting passageway 70 in any suitable manner, for example by means of a friction fit, latch mechanism or the like;
- upper portion 90 of plunger 46 could be coupled to lower portion 92 in any suitable manner, for example by means of a friction fit, latch mechanism or the like;
- the plunger body in any embodiment could be constructed as two separate pieces that are joined in a suitable manner, as described with reference to plunger 46;
- all or portions of the plunger could be constructed from a plurality of separable pieces joined in a suitable manner;
- fluid passageways that connect the lower chamber to the outer surface of the plunger body could optionally be provided in any embodiments of plunger; or
- instruments for measuring certain operating parameters may be secured within the lower chamber of embodiments of the plunger as described for plunger 46, and a bore within the body of the plunger may be internally threaded to receive such instruments.

Mutually non-exclusive features of the embodiments described above can all be incorporated or combined together in other embodiments that are within the scope of the present invention. It is therefore intended that the following appended claims and claims hereafter introduced are interpreted to include all such modifications, permutations, additions and sub-combinations as are within their true spirit and scope.

What is claimed is:

1. A plunger for performing artificial lift in a gas producing well, the plunger comprising:

a plunger body for sealingly engaging a tubing of the well;

a fluid path through the plunger body;

a narrow passageway within the fluid path; and a central orifice at an end of the narrow passageway, wherein the narrow passageway comprises a removable plug having a bore therethrough.

2. A plunger as defined in claim 1, further comprising a radially inwardly directed lip within the fluid path spaced above the central orifice.

3. A plunger as defined in claim 2, wherein the distance between the central orifice and the lip is between 10% and 60% of the total length of a body of the plunger.

4. A plunger as defined in claim 2, wherein the fluid path comprises a lower chamber below the narrow passageway and an upper chamber above the narrow passageway.

5. A plunger as defined in claim 4, wherein the radially inwardly directed lip is on an upper edge of the upper chamber.

6. A plunger as defined in claim 4, wherein the upper chamber, the lower chamber, the central orifice, and the lip all have a circular cross-section and are all concentric about a longitudinal centerline of the plunger.

7. A plunger as defined in claim 1, further comprising a one-way valve disposed to permit fluid flow only from the lower chamber to the upper chamber through the narrow passageway.

8. A plunger as defined in claim 1, wherein the plunger is approximately 25 cm long with a diameter of approximately 5 cm and weighs less than 1.8 kg.

9. A plunger as defined in claim 8, wherein the plunger weighs approximately 0.9 kg.

10. A plunger as defined in claim 1, wherein a majority of the material of the plunger by volume is a material having a density of less than 4.54 g/cm$^3$.

11. A plunger as defined in claim 1, wherein the ratio of the diameter of the central orifice to the ratio of the diameter of the plunger is in the range of 1:25 to 1:2.5.

12. A plunger as defined in claim 11, wherein the ratio of the diameter of the central orifice to the ratio of the diameter of the plunger is about 1:10.

13. A kit comprising a plunger as defined in claim 1 and two removable plugs, wherein the bore of each of the two removable plugs has a different diameter.

14. A plunger for performing artificial lift in a gas producing well, the plunger comprising:

a plunger body for sealingly engaging a tubing of the well;

a fluid path through the plunger body;

a narrow passageway within the fluid path; and a central orifice at an end of the narrow passageway, wherein the plunger comprises an upper half and a lower half detachably coupled together.

15. A plunger as defined in claim 14, wherein the upper half comprises a magnetic metallic material and the lower half comprises titanium.

16. A plunger for performing artificial lift in a gas producing well, the plunger comprising:

a plunger body for sealingly engaging a tubing of the well;

a fluid path through the plunger body;

a narrow passageway within the fluid path;

a central orifice at an end of the narrow passageway; and an instrument for measuring one or more of temperature and pressure, wherein the narrow passageway comprises an internal threaded portion and the instrument is secured to the internal threaded portion.

17. A plunger for performing artificial lift in a gas producing well, the plunger comprising:

a plunger body for sealingly engaging a tubing of the well;

a fluid path through the plunger body;

a narrow passageway within the fluid path;

a central orifice at an end of the narrow passageway; and a bypass valve, the bypass valve comprising:

a cage coupled to the bottom end of the plunger body; and a pin having a head and a shaft, the pin being slideably retained within the cage and movable between an open position wherein the bypass valve allows gas and liquid to flow through the fluid path and a closed position wherein the pin engages a bottom of the plunger body to limit the flow of gas and liquid through the fluid path, wherein the narrow passageway extends through the head of the pin.

18. A plunger as defined in claim 17, wherein the passageway comprises three symmetrically disposed fluid passageways extending through the head of the pin, the three fluid passageways being in fluid communication with the central orifice.

19. A plunger as defined in claim 17, further comprising an internal constriction within the fluid path above the narrow passageway.

20. A plunger for performing artificial lift in a gas producing well, the plunger comprising:

a plunger body for sealingly engaging a tubing of the well;

a fluid path through the plunger body;

a narrow passageway within the fluid path;

a central orifice at an end of the narrow passageway; and a bypass valve, wherein the bottom end of the plunger comprises a seat for receiving a seal, the seat comprising one or more grooves configured to permit fluid to flow to the narrow passageway when the seal is sealingly engaged with the seat.

21. A plunger as defined in claim 20, wherein the seal is a ball and the seat is curved to sealingly engage the ball.

22. A plunger for performing artificial lift in a gas producing well, the plunger comprising:

a plunger body for sealingly engaging a tubing of the well;

a fluid path through the plunger body;

a narrow passageway within the fluid path;

a central orifice at an end of the narrow passageway;

a bypass valve; and fluid channels through the body of the plunger for permitting fluid to flow through the narrow passageway when the bypass valve is in a closed position.

23. A method of using a plunger to perform artificial lift in a gas-producing well, the method comprising the steps of:

allowing a plunger having a plunger body with a fluid path therethrough to fall within a tubing of a well to the bottom of the well the body sealingly engaging the tubing;

allowing gas pressure to move the plunger upwardly within the tubing; and while the plunger is moving upwardly:

allowing fluid to pass through a narrow passageway within the fluid path, the narrow passageway defined by a removable plug in the plunger body, the plug having a bore therethrough, the narrow passageway further having a central orifice at one end.

24. A method as defined in claim 23, further comprising the step of allowing the fluid exiting the central orifice to interact with a radially inwardly directed lip on the plunger.

25. A method as defined in claim 23, wherein the plunger has a weight of 2.3 kg or less and is operated to travel in the tubing at maximum speeds of at least 4 m/s.

26. A method as defined in claim 25, wherein the steps of allowing the plunger to fall and allowing gas pressure to move the plunger upwardly are repeated at a frequency of up to 6 times per hour.

27. A plunger having a bypass valve for performing artificial lift in a gas producing well, the plunger comprising:

a plunger body for sealingly engaging a tubing of the well, the plunger body having a fluid path therethrough;

a cage coupled to the bottom end of the plunger body;

a pin having a head and a shaft, the pin being slideably retained within the cage and movable between an open position wherein the bypass valve allows fluid to flow through the bypass valve and a closed position wherein the pin engages a bottom portion of the plunger body to limit the flow of gas and liquid through the bypass valve;

at least one fluid channel through the head of the pin in fluid communication with a central orifice in the pin, the central orifice being in fluid communication with the fluid path; and a radially inwardly directed lip within the fluid path spaced above the central orifice.

* * * * *